US007677521B2

(12) United States Patent
Price

(10) Patent No.: US 7,677,521 B2
(45) Date of Patent: Mar. 16, 2010

(54) ADJUSTABLE WALL HANGER ASSEMBLY

(76) Inventor: Cory D. Price, 2588 Cimarron La., Rockford, IL (US) 61109

( * ) Notice: Subject to any disclaimer, the term of this patent is extended or adjusted under 35 U.S.C. 154(b) by 380 days.

(21) Appl. No.: 11/732,740

(22) Filed: Apr. 4, 2007

(65) Prior Publication Data

US 2007/0187566 A1 Aug. 16, 2007

Related U.S. Application Data

(63) Continuation-in-part of application No. 11/124,778, filed on May 9, 2005, now Pat. No. 7,201,357.

(51) Int. Cl.
*A47G 1/16* (2006.01)

(52) U.S. Cl. ..... 248/475.1

(58) Field of Classification Search ..... 248/477, 248/475.1, 476, 466, 488, 490, 495, 496
See application file for complete search history.

(56) References Cited

U.S. PATENT DOCUMENTS

| | | | | |
|---|---|---|---|---|
| 2,532,162 | A | 11/1950 | Goss | |
| 2,696,962 | A | 12/1954 | Goss | |
| 2,975,994 | A | 3/1961 | Goss | |
| 3,360,229 | A | 12/1967 | Beyer | |
| 3,900,923 | A | 8/1975 | Thomas | |
| 3,945,599 | A | 3/1976 | Spier et al. | |
| 4,340,199 | A | 7/1982 | Brock | |
| 4,364,537 | A | 12/1982 | Helzer | |
| 4,557,455 | A * | 12/1985 | Benjamin | 248/496 |
| 4,632,438 | A * | 12/1986 | McKinney | 292/87 |
| 5,040,712 | A | 8/1991 | Pesonen et al. | |
| 5,480,120 | A | 1/1996 | Bruner | |
| 5,584,462 | A | 12/1996 | Reese | |
| 6,299,123 | B1 | 10/2001 | Hayde | |
| 6,666,425 | B1 | 12/2003 | Ferguson | |

* cited by examiner

*Primary Examiner*—J. Allen Shriver, II
*Assistant Examiner*—Erin Smith
(74) *Attorney, Agent, or Firm*—Meroni + Meroni, P.C.; Charles F. Meroni, Jr.; Christopher J. Scott

(57) ABSTRACT

An adjustable hanger assembly comprises a hanger, a hanger mount, and a bracket assembly. The hanger comprises a first set of serrations, a center slot, and a hanger tab. The hanger mount comprises a second set of serrations, and a mount aperture. The hanger mount aperture is positioned in coplanar alignment with the center slot axis. The hanger and the hanger mount are assembled together by meshing the serrations in the first and second sets of serrations in a pre-selected position to accommodate users' positioning requirements. A mounting fastener extends through the hanger and the hanger mount for clamping the abutting assembly together and mounting the same to a wall. The hanger assembly is laterally positionable within, and snap-fittable to, the bracket assembly. Together the hanger assembly and the bracket assembly enable the user to adjust the target wall-hanging in two-dimensional space.

29 Claims, 16 Drawing Sheets

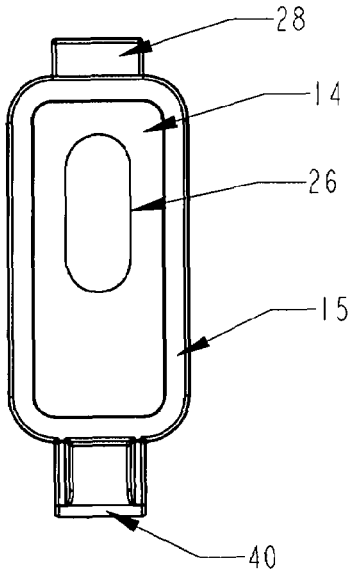
FIG. 6
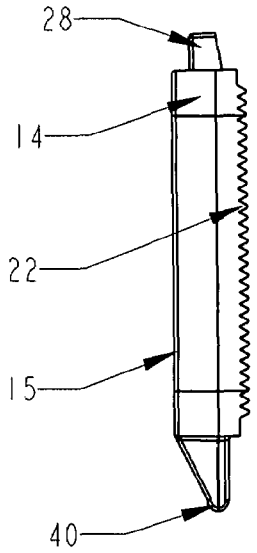
FIG. 7
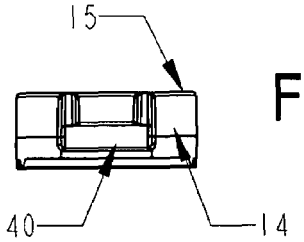
FIG. 8
FIG. 9
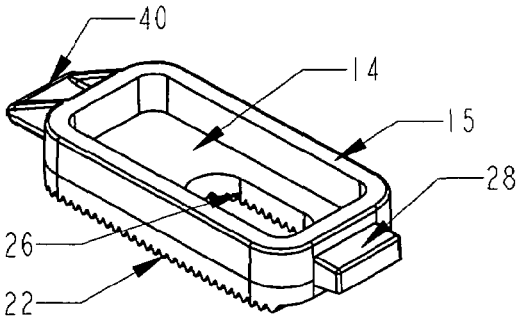
FIG. 10
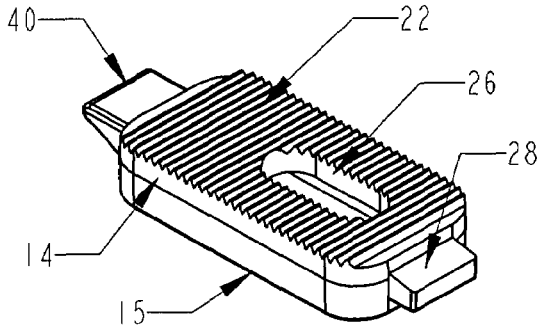

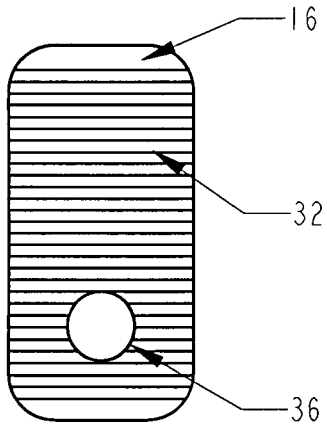
FIG. 11
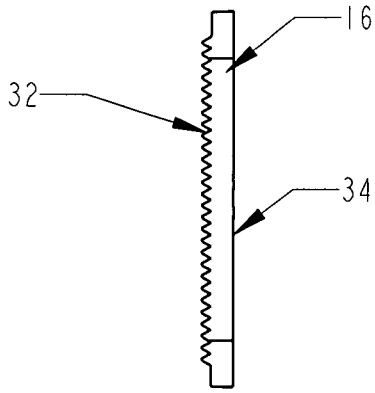
FIG. 12
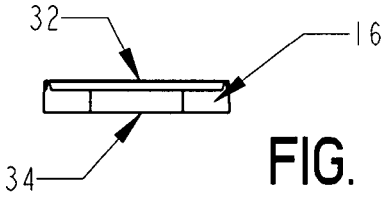
FIG. 13
FIG. 14
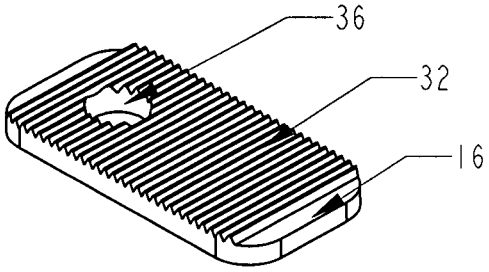
FIG. 15
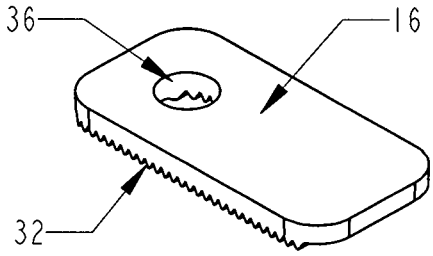

ADJUSTABLE WALL HANGER ASSEMBLY

PRIOR HISTORY

This application is a continuation-in-part patent application claiming the benefit of U.S. patent application Ser. No. 11/124,778, now U.S. Pat. No. 7,201,357 filed in the United States Patent and Trademark Office on May 9, 2005, and any legal equivalent thereto.

BACKGROUND OF THE INVENTION

1. Field of the Invention

The present invention generally relates to an assembly for enabling vertical and horizontal adjustment to a wall-hanging. More particularly, the present invention relates to a wall-hanging assembly for adjustably hanging or suspending photographs, mirrors, paintings and the like on an indoor or outdoor building wall surface.

2. Description of the Prior Art

Heretofore various adjustable wall hangers have been proposed in some form or another utilizing the theory of attaching an adjustable hanger to a vertical wall surface for mounting pictures, photographs, mirrors, and the like. Some of the more pertinent prior art relating to the adjustable wall hangers and the like are briefly described hereinafter.

U.S. Pat. No. 2,532,162 ('162 patent), which issued to Goss, discloses certain Object Supporting Means. The '162 patent teaches a device for supporting an and opening upwardly. The hooks on the upper strip project upwardly and open downwardly and are mounted for vertical adjustment.

U.S. Pat. No. 4,364,537 ('537 patent), which issued to Helzer, discloses an Adjustable Plate Holder. The '537 patent teaches an adjustable holder for a planar object such as a plate. The holder is comprised of a base having a channel therein in which an arm is received. The arm is frictionally held in the channel of the base and has a hooked upper end. At the lower part of the base, means to removably attach a pair of feet is provided. Where the holder is to be freestanding, the pair of feet extend forwardly and sidewardly of the base. Where the holder is to be mounted on a wall, an alternative pair of feet is provided which extend downwardly as well as forwardly and sidewardly.

U.S. Pat. No. 4,632,438 ('438 patent), which issued to McKinney, discloses an Adjustable Safety Latch with Inoperable Position. The '438 patent teaches a child proof safety latch for a cabinet door or drawer. The safety latch includes a base plate receivable on the door, with a hook extending from the base plate to engage the cabinet. A holding plate is provided to locate the base plate, and the holding plate and base plate have teeth for ratchet adjustment of the base plate. A screw passes through the holding plate and the base plate to secure the latch to the door, and the latch is rotatable to place the hook in a position so the hook will not engage the cabinet. The latch therefore has an operable position and an inoperable position.

U.S. Pat. No. 5,584,462 ('462 patent), which issued to Reese, discloses an Adjustable Wall Hanger. The '462 patent teaches a hanger for adjustably suspending an object from a wall. The device of the '462 patent comprises a wall bracket object such as a mirror, picture, or the like. The device of the '162 patent comprises a first, generally flat member, adapted to be supported flat wise to a support. The first flat member has opposing side margins turned over to form a pair of spaced grooves opening at least one end margin of the first flat member. A second, generally flat member is assemblable with the first flat member by inserting the second member with the grooves from the end margin, and is held in flat wise sliding action relative to the first flat member by guiding action of the surfaces defining the grooves. The second member comprises means for engaging a target object and detent means comprising a corrugated surface on the flat portion of the first member and a resilient tongue on the flat portion of the second member. The tongue is adapted to selectively seat in any one of the troughs formed by the corrugated surface to thereby yieldably hold the first and second members in any one of a number of adjusted positions.

U.S. Pat. No. 2,696,962 ('962 patent), which issued to Goss, discloses a Mirror Mounting and Supporting Device. The '962 patent teaches a device for mounting and supporting an object such as a sheet glass mirror. The device comprises a pair of substantially flat strips adapted to be fastened to a wall in spaced parallel horizontal position and spaced longitudinal ribs upon the rear face of each strip for contact with a wall. There are spaced parallel rows of apertures in each strip, means selectively inserted through certain of the apertures for attaching the strips to a wall. Certain object supporting devices are secured to the fronts of the strips having hooks for engaging over opposite edges of the mirror and holding the mirror spaced from the strips. The hooks of the object supporting devices upon the lower strip projecting downwardly securable to a wall surface. An adjustable bracket is slidably positioned through the wall bracket and includes a depending hook for suspending an object. A securing fastener is directed through the adjustable bracket and can be rotatably advanced to lock the adjustable bracket relative to the wall bracket in a desired position.

U.S. Pat. No. 6,666,425 ('425 patent), which issued to Ferguson, discloses a Vertically Adjustable Picture Hanger. The '425 patent teaches a vertically adjustable picture hanger comprising a main body securable to a vertical surface with mounting screws, nails, or other similar fasteners, and an adjustable bracket. The main body includes a pair of mounting apertures and is generally symmetrical about a plane passing through the axes of the mounting apertures, a vertically-oriented linear ratchet having a plurality of teeth, and a pair of parallel, outwardly-facing spaced apart peripheral tracks or grooves. Each track is open at the top and includes a pair of cylindrical locator pins that enter the tracks at the top of the main body and slide within them. Also included in the adjustable bracket is a pawl that engages the linear ratchet. The locator pins allow the adjustable bracket to be rotated upwardly so the pawl can be disengaged from the linear ratchet, the adjustable bracket moved up or down, and the pawl re-engaged with the ratchet.

It may be seen from an inspection of the noted prior art that the same does not disclose the unique structural configurations possessed by my vertically and horizontally adjustable wall hanger device for adjustably suspending a photograph, a painting or similar object to be mounted on an upright wall which may be inexpensively manufactured and easily operated by a person that needs to make a quick and accurate placement of a wall hanger device with a minimum of difficulty. The prior art thus perceives a need for vertically and horizontally adjustable wall hanger device for adjustably suspending a photograph, a painting or similar object to be mounted on an upright wall which may be inexpensively manufactured and easily operated by a person that needs to make a quick and accurate placement of a wall hanger device with a minimum of difficulty.

SUMMARY OF THE INVENTION

More specifically, the vertically and horizontally adjustable wall-hanging assembly of the present invention provides a relatively lower profile as compared to the prior art. In other words, the profile of the adjuster assembly of the present invention does not protrude out as far from the mount surface as opposed to other known picture hangers. Further, the vertically and horizontally adjustable wall-hanging assembly of the present invention sets forth certain other features and advantages, as set forth in more detail hereinafter.

The vertically adjustable portion of the wall hanger device has a single mounting point, requiring only one hole in the mounting surface as distinguished from other wall hangers which require multiple mounting points.

The vertically adjustable portion of the wall hanger device permits a much finer adjustment down to 1/32 of an inch as distinguished from other designs requiring large adjustments.

The vertically adjustable portion of the wall hanger device has a mounting screw that goes through both pieces making it more secure as distinguished from other designs where the screw passes through only one of two pieces.

The vertically adjustable portion of the wall hanger device has sets of serrations on two pieces which are shaped and configured so as to enable the pieces to be vertically moved relative to each other so that the serrations on the pieces can be engaged at different locations to permit much finer adjustment down to 1/32 of an inch without the use of dual opposing cams or dowels as set forth in U.S. Pat. No. 6,666,425.

The horizontally adjustable portion of the wall-hanging assembly provides snap-fit assemblage with a bracketed wall-hanging, which bracketed wall-hanging may be snap fit to the vertically adjustable portion of the wall-hanging assembly.

The horizontally adjustable portion of the wall-hanging assembly provides a bracket width substantially greater in magnitude than the width of the vertically adjustable portions of the wall-hanging assembly. The enhanced width of the bracket assembly, snap-fittable with the vertically adjustable hanger assembly, may well function to enable the installer or other article-hanger to horizontally and vertically adjust the target wall-hanging as may be required.

To achieve these and other readily apparent objectives, the present invention essentially provides an adjustable wall hanger device or wall-hanging assembly essentially comprising a hanger assembly having a hanger and a hanger mount (for enabling vertical adjustment) and a clip bracket or bracket assembly snap-fittable or otherwise cooperable with the hanger assembly (for enabling horizontal adjustment). The hanger comprises a main hanger body, a first set of serrations positioned in side-to-side spaced relation to one another on a back side of the main hanger body, a center slot on the main hanger body, and a hanging tab provided on an upper section of an annular rim of the main hanger body. The hanger mount comprises a main mount body having a second set of serrations on one of its faces positioned in side-to-side spaced relation and sized and shaped similar to, and confronting, the first set of serrations.

More particularly, the second set of serrations is located on a back side of the main hanger mount body with the hanger mount body having a screw of fastener-receiving hole confronting the center slot on the main hanger body. A center hanger mount is held in the main mount body positioned in alignment with the center slot provided in the main hanger body. The hanger and the hanger mount are assembled together by meshing the serrations in the first and second sets of serrations in a pre-selected position to accommodate users' positioning requirements, and a mounting screw or fastener extends through the hanger body and the center hanger mount in clamped abutting assembly together to hold the hanger and the hanger mount in superimposed lapped engagement together in the pre-selected position.

The clip bracket or bracket assembly is preferably C-shaped in cross section and comprises a main bracket body, a hanger pocket, a flexible snap arm, and means for fastening the clip bracket to a target wall-hanging such as certain fasteners or screws as well as fastener-receiving apertures. As fastened to the target wall-hanging, the clip bracket assembly and the wall-hanging thus form a bracketed wall-hanging. The hanger pocket functions to slidably receive the hanger tab for enabling horizontal adjustment and the flexible snap arm is elastically deformable or displaceable for receiving the snap bar. The snap bar may thus be retained in position as the flexible snap arm is restored to its relaxed equilibrium position. The relaxed equilibrium position thus enables the snap arm to engage the snap bar and thus snap-fit the hanger to the clip bracket via the hanger tab and snap arm. It should thus be seen that the bracketed wall-hanging is snap-fittable to the hanger assembly.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings:

FIG. 6 is an anterior view of a hanger body of the hanger assembly of the present invention.

FIG. 7 is a right lateral side view of the hanger body otherwise depicted in FIG. 6.

FIG. 8 is an inferior end view of the hanger body otherwise depicted in FIG. 6.

FIG. 9 is an anterior superior perspective view of the hanger body otherwise depicted in FIG. 6.

FIG. 10 is a posterior superior perspective view of the hanger body otherwise depicted in FIG. 6.

FIG. 11 is an anterior view of a hanger mount of the hanger assembly of the present invention.

FIG. 12 is a right lateral side view of the hanger mount otherwise depicted in FIG. 11.

FIG. 13 is an inferior end view of the hanger mount otherwise depicted in FIG. 11.

FIG. 14 is an anterior superior perspective view of the hanger mount otherwise depicted in FIG. 11.

FIG. 15 is a posterior superior perspective view of the hanger mount otherwise depicted in FIG. 11.

BRIEF DESCRIPTION OF THE PREFERRED EMBODIMENT(S)

Figure 1:
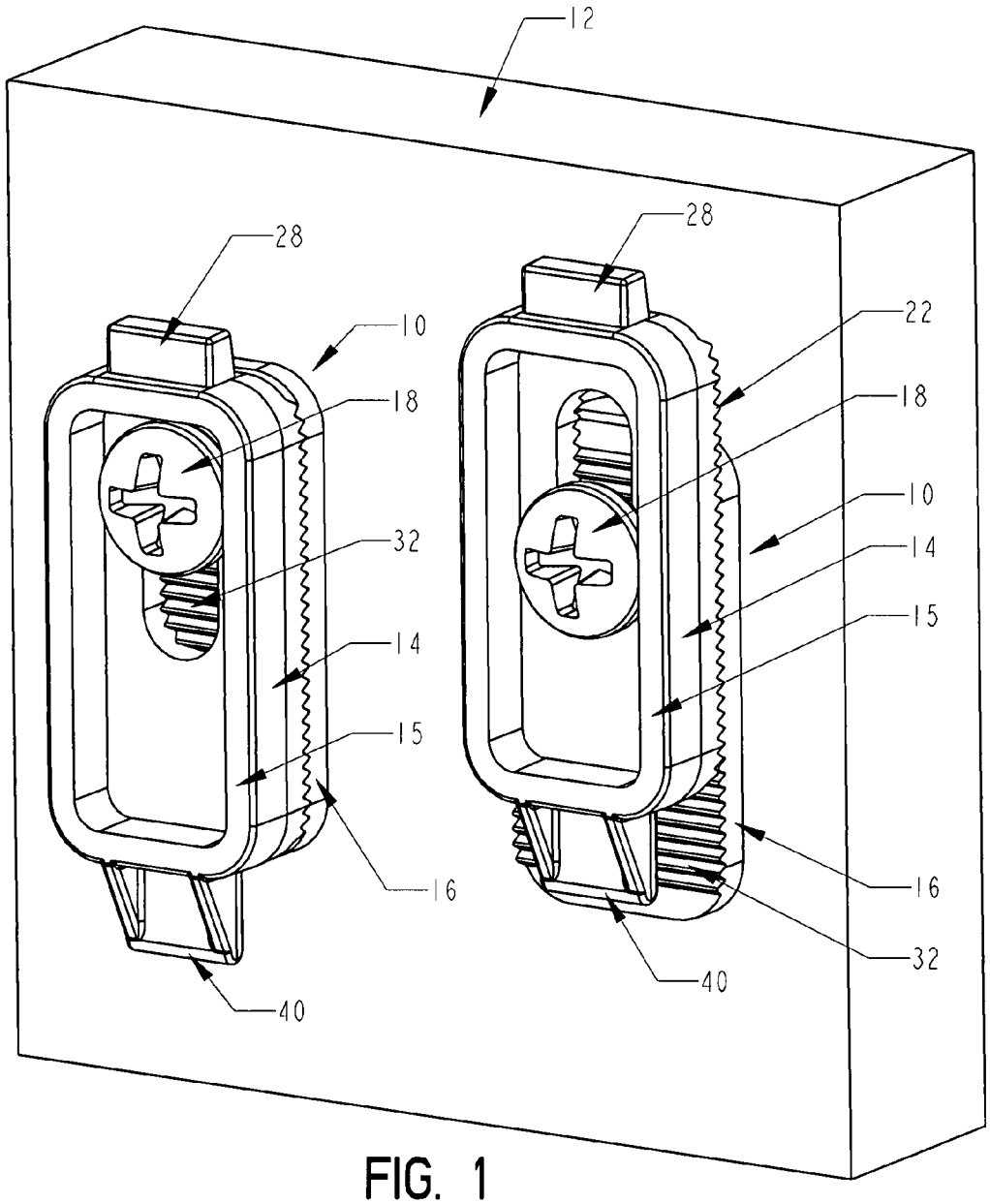
FIG. 1 is an anterior perspective view of laterally opposed hanger assemblies of the present invention, the left hanger assembly being screw-mounted a first vertical orientation and the right hanger assembly being screw-mounted in a second vertical orientation relatively superior to the first vertical orientation.
Figure 2:
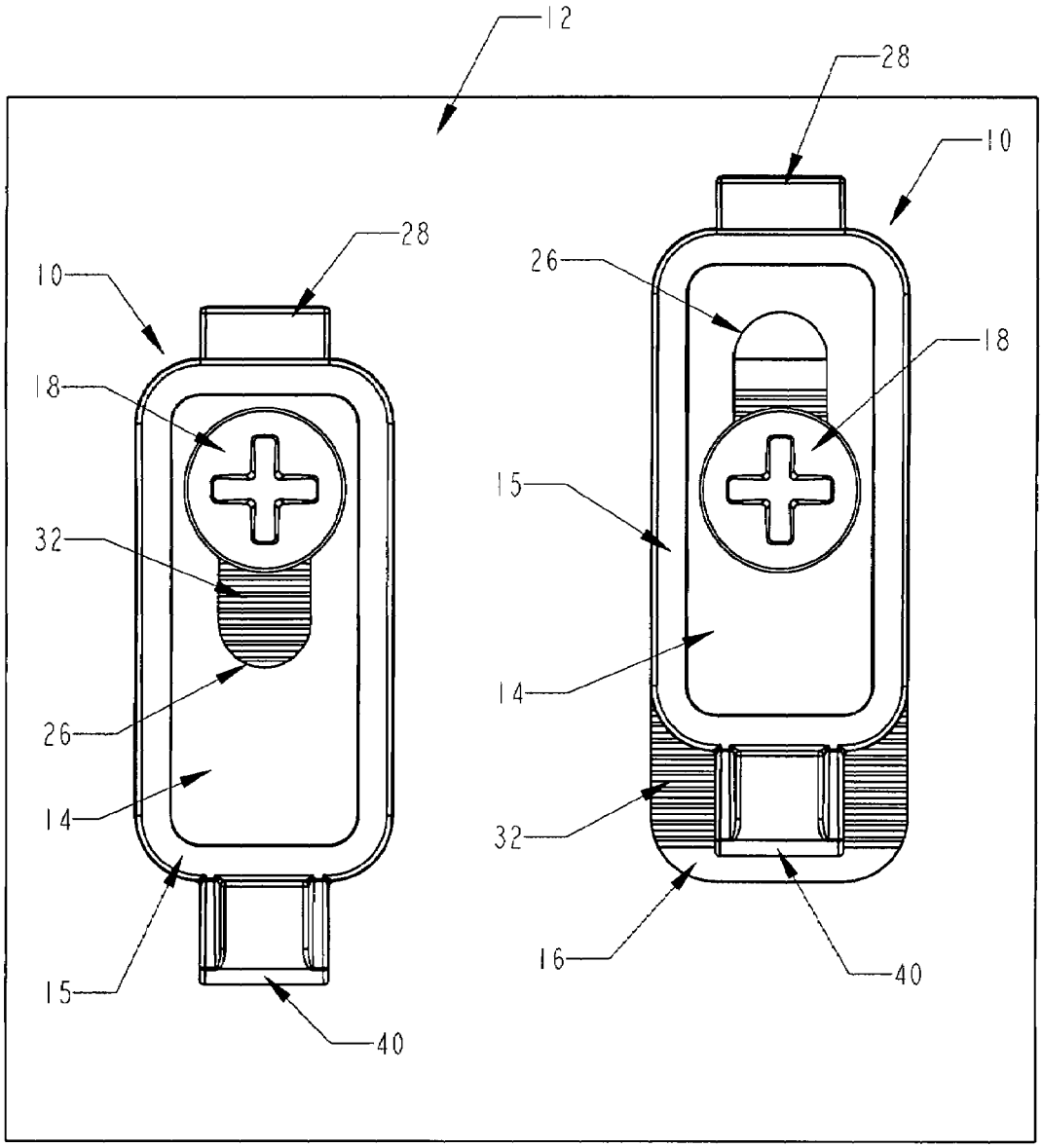
FIG. 2 is an anterior plan view of laterally opposed hanger assemblies otherwise depicted in FIG. 1.
Figure 3:
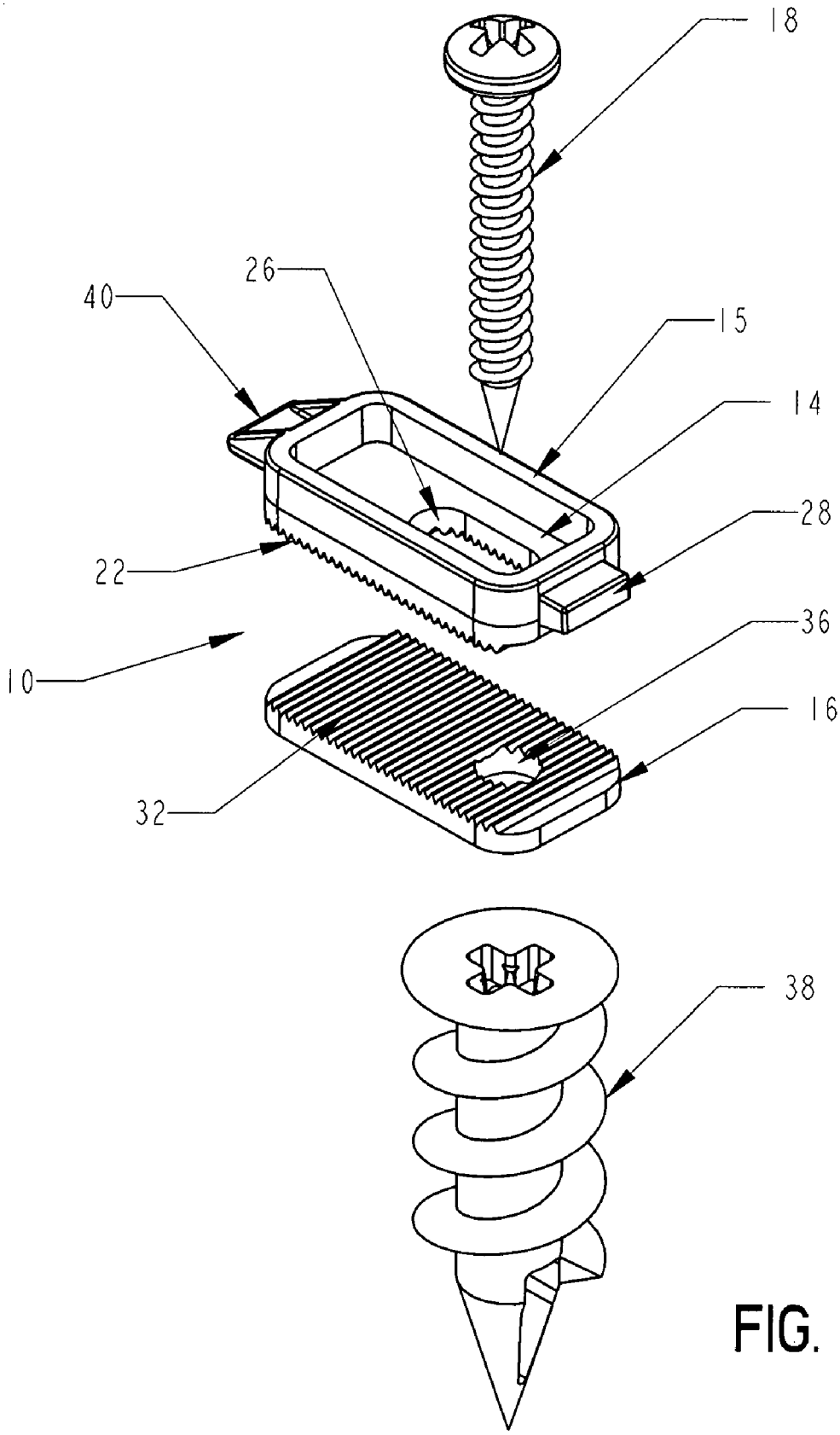
FIG. 3 is an exploded type depiction of the hanger assembly of the present invention as aligned for receipt of a fastening screw mountable in an optional drywall anchor.
Figure 4:
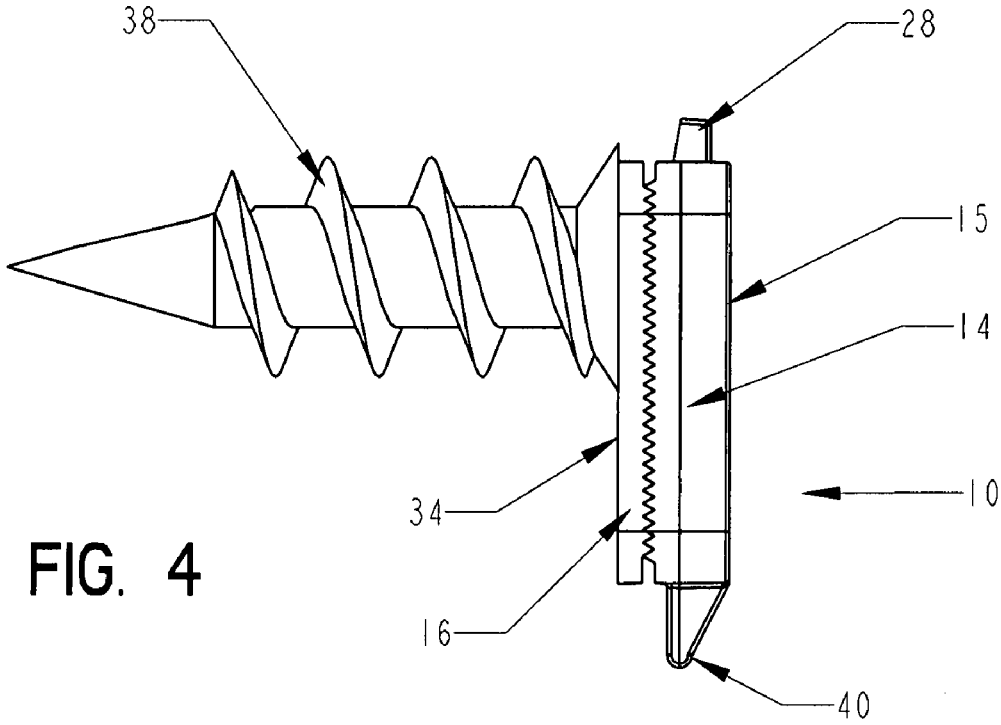
FIG. 4 is a left lateral side plan view of the laterally left hanger assembly screw-mounted the first vertical orientation otherwise depicted in FIG. 1.
Figure 5:
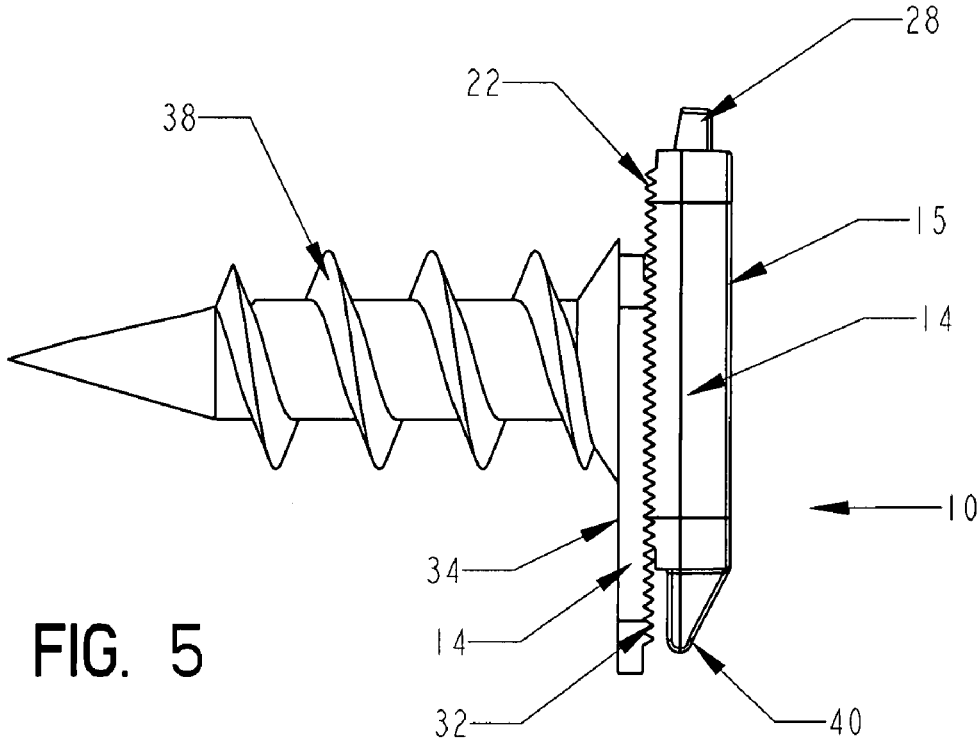
FIG. 5 is a left lateral side plan view of the laterally right hanger assembly screw-mounted the second vertical orientation otherwise depicted in FIG. 1.

Referring now to the drawings with more specificity, the preferred practice of the present invention generally involves or concerns a new and improved adjustable wall-hanging assembly or hanger assembly 10 as generally illustrated and referenced in FIGS. 1-5, 16-22, and 28. It is contemplated that this hanger assembly 10 is adapted for hanging pictures, photographs, mirrors, and paintings and other assorted articles where it is desired to mount the same on a wall 12 as generally illustrated and referenced in FIGS. 1, 2, and 16-20). The noted figures generally illustrate and depict the hanger assembly 10 of the present invention. FIGS. 16-19 generally illustrate and depict how the adjustable hanger assembly 10 of the present invention may be effectively adjusted.

The adjustable hanger or hanger assembly of the present invention may be said to preferably comprise three parts, namely, a dish-shaped hanger 14 as illustrated and referenced in FIGS. 1-10, 16-22, 28, and 31-33; a hanger mount 16 as illustrated and referenced in FIGS. 1-5, 11-22, and 28; and a mounting fastener, as preferably defined by a screw 18 as illustrated and referenced in FIGS. 1-3, 16-22, and 28. As may be seen from an inspection of the noted figures, the hanger 14 is preferably dish-shaped in accordance with the features of this invention. In other words, the hanger 14 comprises a raised annular rim as at 15 for hollow-concealing received fasteners and the like as may be gleaned from a further comparative inspection of FIG. 1 versus FIGS. 4, 5, and 16-20. It is contemplated that the parts 14 and 16 may be constructed from any number of suitable materials, including suitable synthetic plastic or polymeric materials such as can be manufactured by using known types of injection molding equipment or die-cast metallic materials.

The dish-shaped hanger 14 preferably comprises a main body or main hanger body, which body comprises a first set of serrations 22 as illustrated and referenced in FIGS. 1, 3, 5, 7, 9, 10, and 21; a center slot 26 as illustrated and referenced in FIGS. 2, 3, 6, 9, 10, 21, and 31-33; a snap bar 40 as illustrated and referenced in FIGS. 1-10, 16-22, 28, and 31-33; and certain means for retaining a wall-hanging 17. It is contemplated that the means for retaining a wall-hanging 17 may be preferably defined by a hanging tab or hanger tab 28 as illustrated and referenced in FIGS. 1-7, 9, 10, 16-22, and 28. It may be readily seen from an inspection of the noted figures that serrations 22 are formed on back side or posterior side of the hanger 14.

The hanger mount 16 preferably comprises a main body or main mount body, which body comprises a second set of serrations 32 as illustrated and referenced in FIGS. 1-3, 5, 11-14, and 15. It may be readily understood from an inspection of the noted figures that serrations 32 are formed on a front side or anterior side of the hanger mount 16. The hanger mount 16 further preferably comprises a substantially planar back side or posterior side 34 for flush wall engagement as generally referenced in FIGS. 4, 5, 12, 13, and 21. Further, the hanger mount 16 preferably comprises a center mount hole or mount aperture 36 for receiving a mounting fastener as may be preferably defined by a mounting screw 18. Aperture 36 is generally illustrated and referenced in FIGS. 3, 11, 14, 15, and 21.

The hanger 14 and hanger mount 16 are assembled together by meshing or nesting the sets of serrations 22 and 32 and these two parts are held in place by the mounting screw 18 having internal threads coacting with the threaded screw-receiving member 38. In the illustrated preferred embodiment, the serrations in both sets 22 and 32 are of identical size and shape with unobstructed free and open ends so that the sets can be easily adjusted relative to one another for ease of assembly in an optimum adjusted position.

Notably, an important object of our invention is to provide a wall hanger device or wall-hanging assembly 10 which has only a single mounting point, requiring only one hole in the mounting wall or surface 12 so as to minimize the number of wall holes that must be provided in a vertical wall surface or wall 12. According to another important feature of the invention, our new adjustable hanger assembly 10 enables a much smaller or finer vertical adjustment. In this regard, it is contemplated that the distance intermediate adjacent respective troughs or peaks (i.e. the serration length) is on the order of 1/32 of an inch so as to allow incremental vertical adjustments on the order of 1/32 inch. This feature is believed to be superior in terms of finely adjusting the vertical dimension of a wall-hanging as compared as compared to prior known hangers.

Yet another important feature of the present invention relates to the adjustable hanger 10 where the mounting screw 18 extends through both pieces or parts 14 and 16 of the adjustable assembly 10 making it a more secure construction. To this end, the screw 18 extends through the center slot 26 and into the center mount hole 36 and finally into a threaded screw receiving member 38 as may be preferably defined by a drywall anchor as generally depicted and referenced in FIGS. 3-5, 16-19, 21, 22, 27, 28, and 30. According to still another important feature of the present invention, the adjustable hanger assembly 10 comprises two main bodies, namely hanger 14 and hanger mount 16, which structures have confronting first and second sets of serrations 22 and 32 for nested engagement together in one of a series of selectable positions to obtain a most precise positioning of the first and second sets of serrations 22 and 32 for optimum positioning of the hanger 14 and the hanger mount 16 relative to one another to obtain a finer and an improved adjustment capability.

When it is desired to use the improved adjustable hanger device 10, the user should determine where the article to be hung or the target wall-hanging 17 is to be located on a wall surface 12. There are many writings describing or setting forth how wall hangers are to be made, and there are situations where it is desired to only hang a single article or wall hanging and other situations where multiple wall hangings are to be made in some sort of a pre-designed arrangement on a wall surface. For the purpose of this discussion, the single reference is to set forth how the improved adjustable hanger device or hanger assembly 10 of the present invention can be used to mount a single wall hanger or mount on a wall surface 12.

Figure 17:
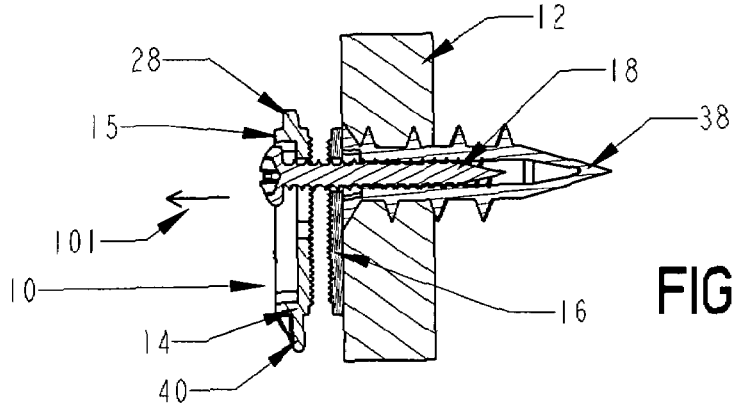
FIG. 17 is a right lateral side, second sequential depiction of the laterally left screw-mounted hanger assembly otherwise shown in FIG. 16 being displaced in a third dimension via release of the screw mount enabling vertical displacement of the hanger body.
Figure 18:
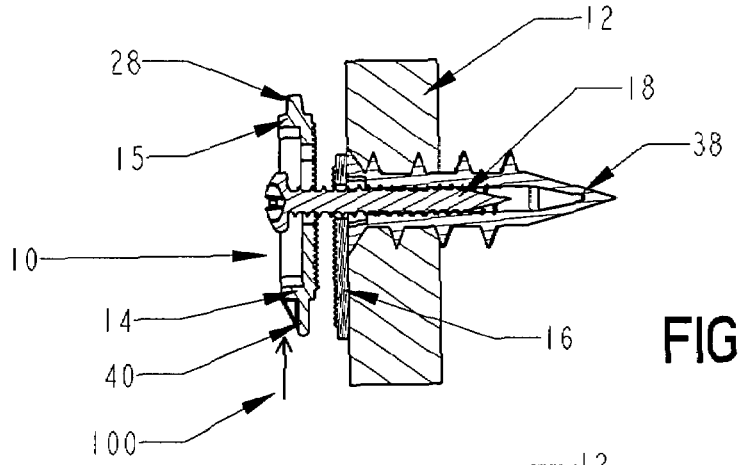
FIG. 18 is a right lateral side, third sequential depiction of the laterally left screw-mounted hanger assembly otherwise shown in FIG. 17 wherein the hanger body is being displaced in a vertical dimension via the released screw mount otherwise depicted in FIG. 17.

To this end, a location on a wall surface must be first chosen. If desired, a threaded screw receiving member 38 can be used to provide a mounting socket having internal screw threads and external screw threads for wall engagement for receipt of a mounting screw 18. After the socket or fastener-receiving structure is provided or targeted, then the screw 18 can be threaded through the center slot 26 on the mount body of the hanger 14 and then through a center mount hole 36 on the hanger mount 16 in such a way that the hanger 14 and the hanger mount 16 are loosely positioned on the mounting screw 18 in spaced apart relation, as generally depicted in FIGS. 17 and 18. At this point in time, the installer can make a judgment about where the hanger tab 28 on the hanger 14 is to be located, whereafter the first and second sets of serrations 22 and 32 are engaged and then the mounting screw 18 is turned so as to cause the hanger 14 and the mount hanger 16 to be clamped with the serrations 22 and 32 in the respective sets then being secured in a pre-selected position. FIG. 18, for example, depicts the direction of movement or of vertical adjustment (as at vector arrow 100) of the mount hanger 16 as the components are being assembled and clamped in adjusted relation.

Figure 16:
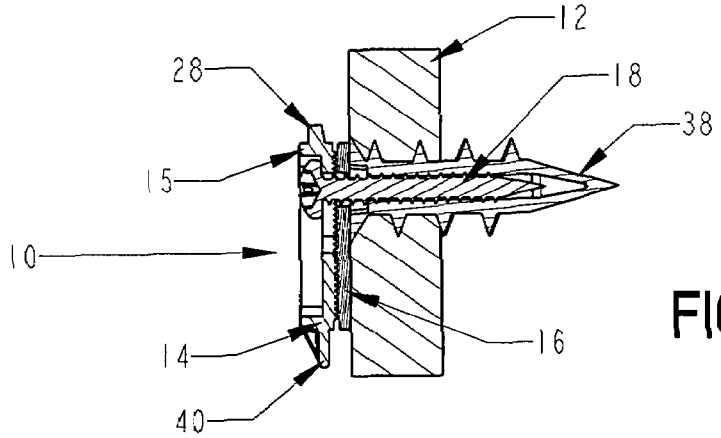
FIG. 16 is a right lateral side, first sequential depiction of the laterally left screw-mounted hanger assembly shown in the first vertical orientation otherwise depicted in FIG. 1.
Figure 19:
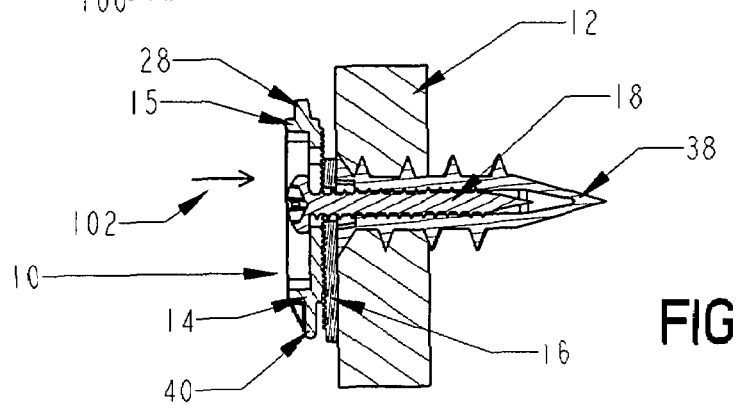
FIG. 19 is a right lateral side, fourth sequential depiction of the laterally left screw-mounted hanger assembly otherwise shown in FIG. 18 wherein the hanger body is being screw-mounted in the second vertical orientation otherwise depicted in FIG. 1.
Figure 20:
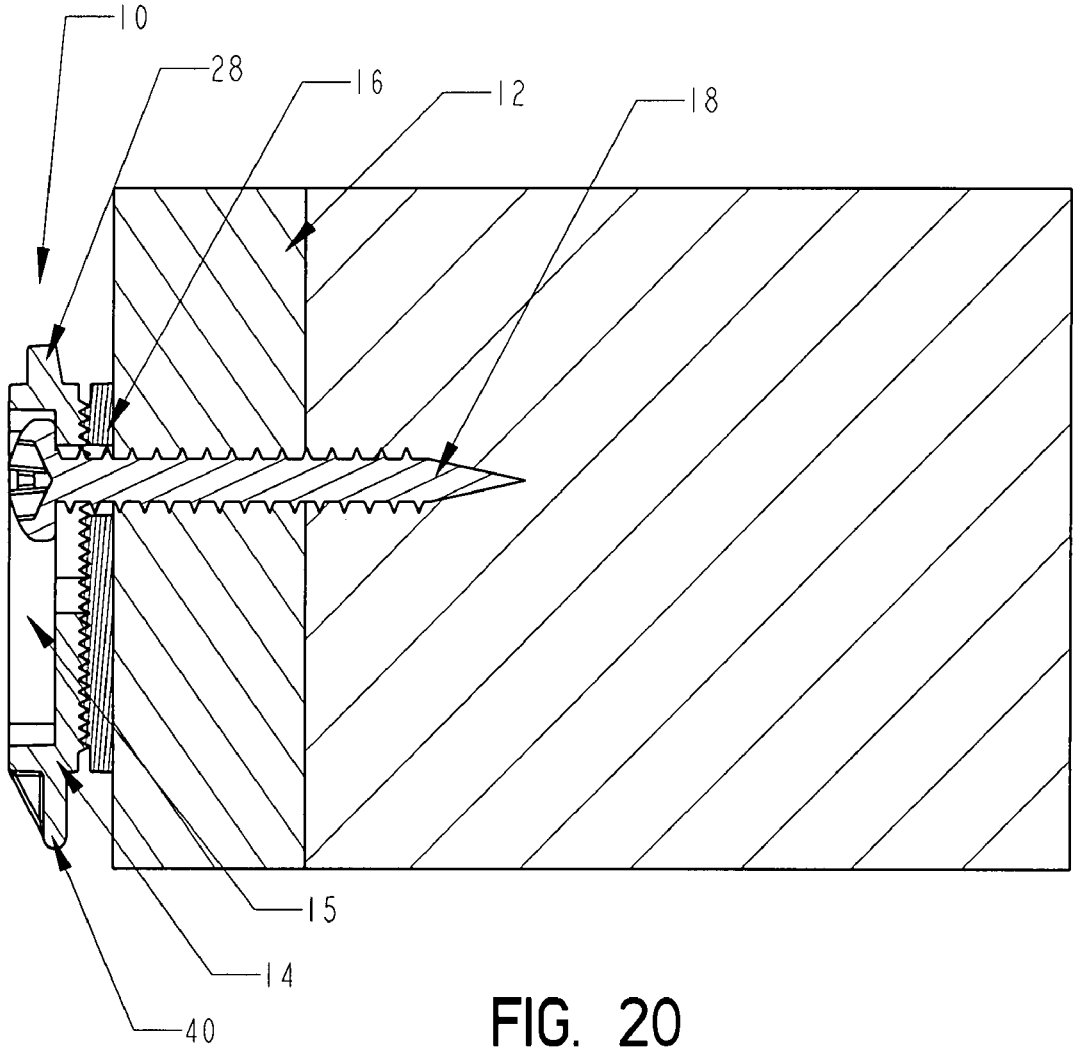
FIG. 20 is an enlarged right lateral side depiction of the laterally left screw-mounted hanger assembly shown in the first vertical orientation and mounted to wall stud via a wall medium.
Figure 21:
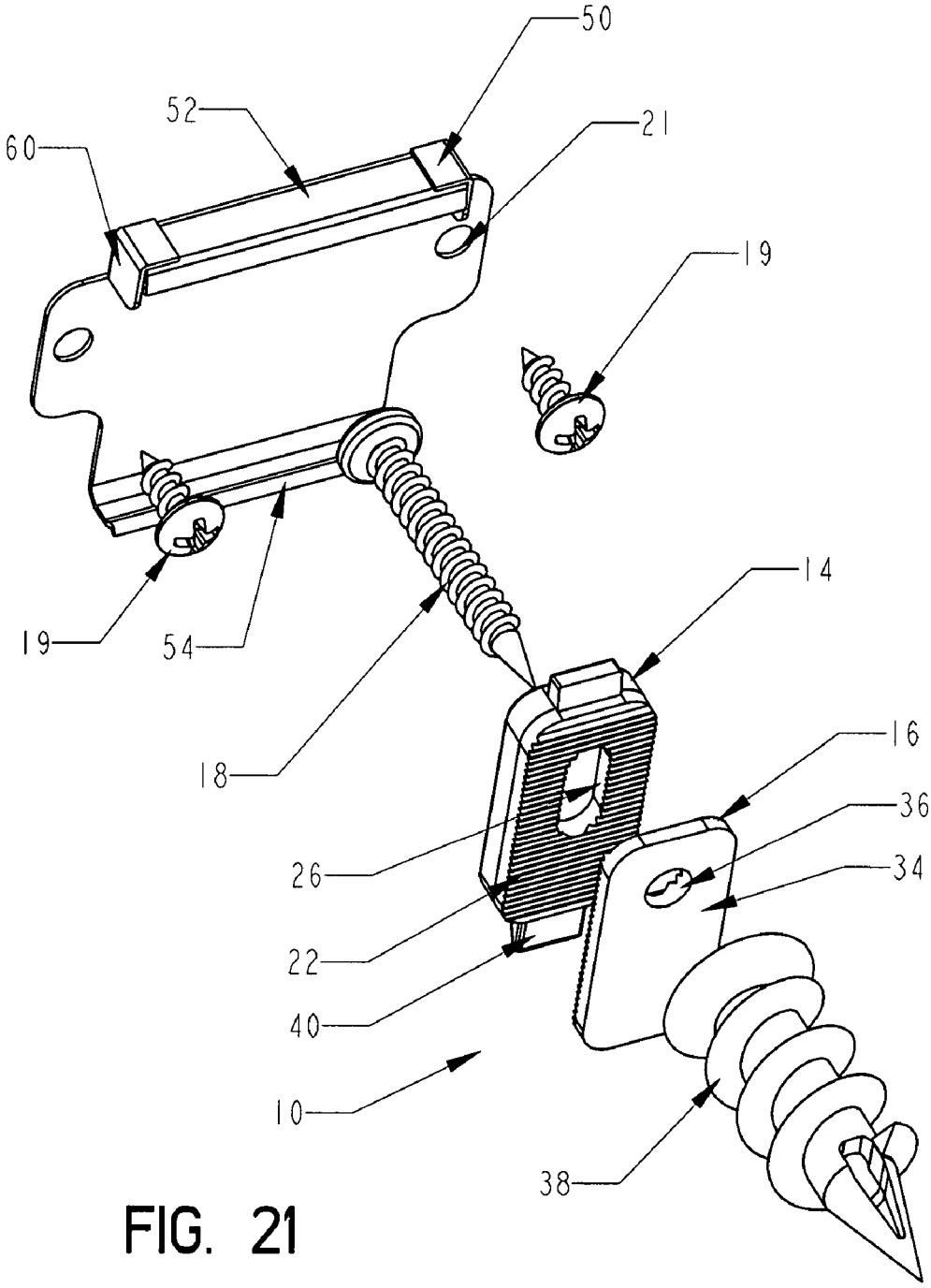
FIG. 21 is an exploded type depiction of the hanger assembly of the present invention juxtaposed adjacent a bracket assembly of the present invention with associated hardware for fastening the hanger and bracket assemblies to opposing media.

By way of comparison, FIG. 16 generally depicts the components in relative position prior to being adjusted and the arrow 101 in FIG. 17 shows how hanger 14 carrying the hanging tab 28 can be moved away from the mount hanger 16 during the time when adjustment is being made between the two sets of serrations 22 and 32. The third dimensional displacement is enabled by loosening the mounted relation via the screw or other fastener as sequentially depicted in FIG. 16 versus FIG. 17. After displacing the hanger 14 in a third dimension (i.e. along the x-axis) as generally depicted in FIG. 17, the vertical adjustment (as at 100) can be made as generally depicted in FIG. 18. Then the sets of serrations 22 and 32 are engaged and clamped together via the screw 18 or similar other fastening means as generally depicted in FIG. 19 as at vector arrow 102. If the vertical adjustment is unsatisfactory to the installer, then the screw 18 can be turned and released to enable the hanger 14 and the mount hanger 16 to be separated (as at 101) so that the serrations 22 and 32 can be disengaged preparatory to set the sets of serrations 22 and 32 in a new position of adjustment.

As earlier specified, the dish-shaped hanger 14 has a unique construction. In this regard, it should be noted that the dish-shaped hanger 14 has an annular rim 15 surrounding the center slot 26. The center slot 26 is preferably located in an upper hanger section surrounded by the annular rim hanger section. The mounting screw 18 preferably has a rounded screw head so that a picture hanger wire or cord is less likely to become snagged on the screw head when it is slipped over the hanger tab 28 when hanging a painting from a hanger wire or cord (not specifically illustrated).

The dish-shaped hanger 14 defines a dished area bounded by the annular rim 15 with the center slot 26 being located at the bottom of the dished area a sufficient depth to allow the screw head to be lodged in the dished area so that the head does not protrude above or outside of the annular rim 15. The annular rim 15 and the dish-shaped hanger 14 may thus be said to operably hollow-conceal the fastener for preventing snags and the like with matter passing thereover, as for example might happen if a picture-hanging wire or cord were to be translated over the dished or hollowed out area.

When the screw 18 is set into the wall 12 to hold the mount hanger 16 and the dish-shaped hanger 14 to the wall 12, and after the sets of serrations 22 and 32 have been adjusted, it will be seen that the rounded screw head is preferably in flush engagement against the bottom of the upper hanger section and surrounded by the annular rim hanger section so that profile of the adjustable wall hanger device 10 can be minimized all according to the features of this invention. The screw 18 can be used as generally depicted throughout the figures. It is contemplated in this last regard that if the wall 12 comprises wood paneling or similar other medium, it may not be necessary to use a threaded screw receiving member 38. Threaded screw receiving members 38 are generally known in this art and are used when the wall 12 is comprised of a softer material where the load of the wall hanging might cause the screw to pull away from the wall 12.

Figure 22:
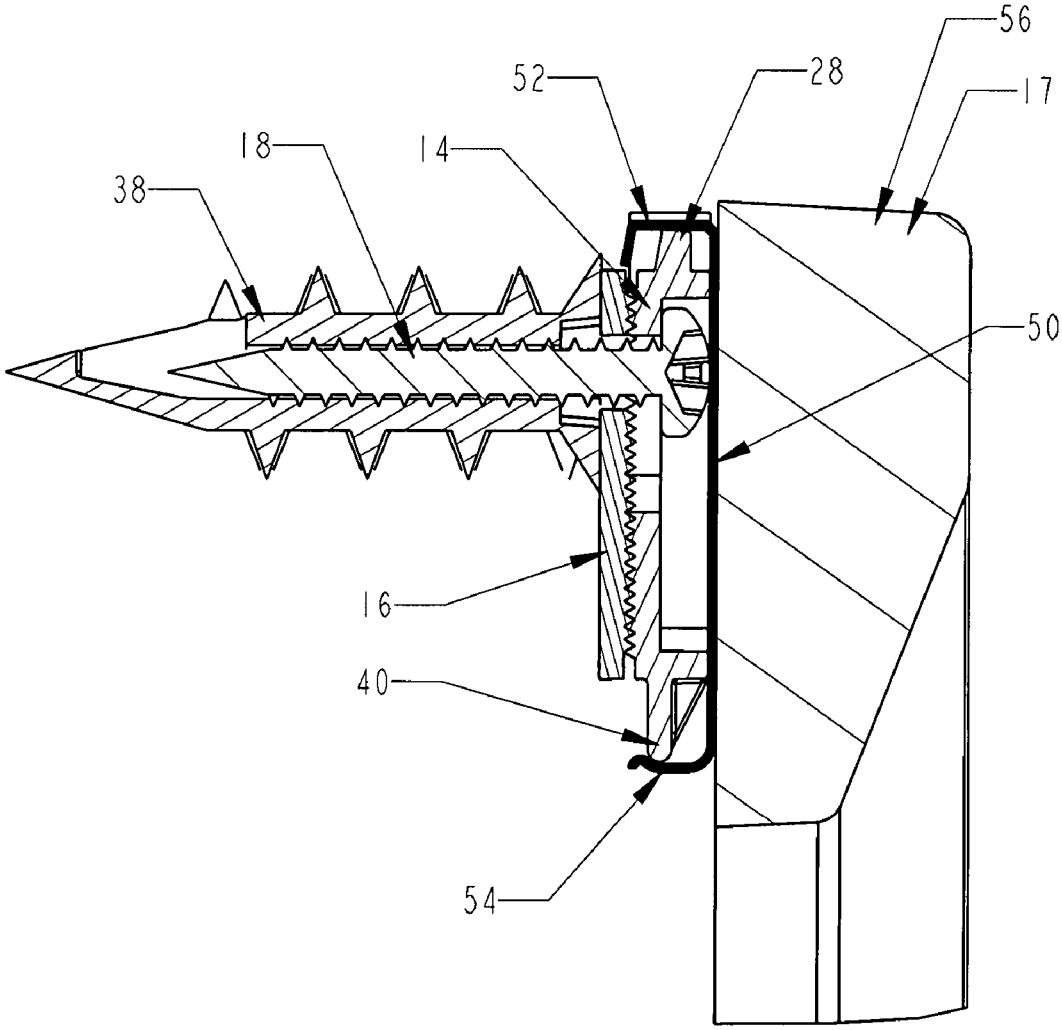
FIG. 22 is an enlarged left lateral side depiction of a screw-mounted hanger assembly shown in the first vertical orientation for mounting to a wall medium and as received in a bracket assembly fastened to a wall-hanging (forming a bracketed wall-hanging) as cooperably engaged with the screw-mounted hanger assembly. Note, the hanger tab of the hanger is received in a hanger pocket of the preferred bracket assembly and the snap bar of the hanger is engaged by a flexible snap arm of the preferred bracket assembly.
Figure 23:
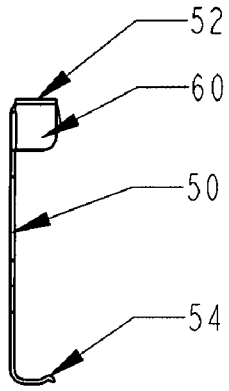
FIG. 23 is a left lateral side view of the clip bracket of the present invention depicting a capped end adjacent the hanger pocket.
Figure 24:
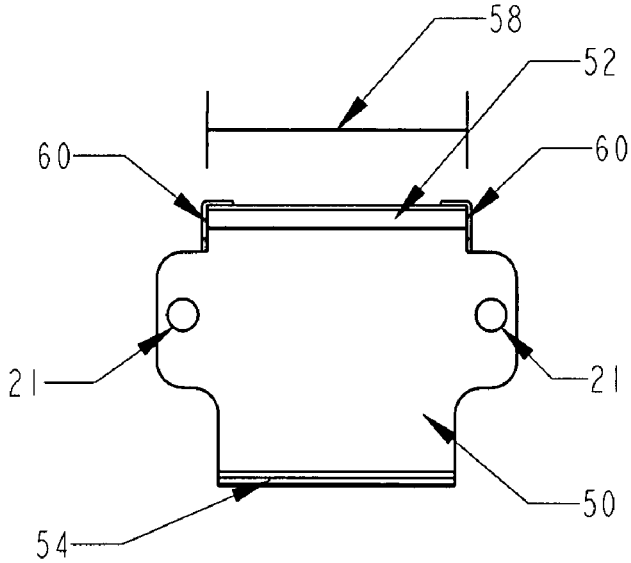
FIG. 24 is a posterior plan view of the clip bracket of the present invention depicting laterally-opposed fastener-receiving apertures.
Figure 25:
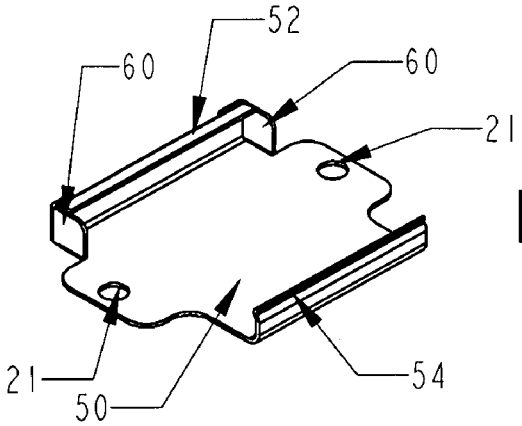
FIG. 25 is an inferior posterior perspective view of the clip bracket of the present invention showing laterally-opposed capped ends of the hanger pocket, laterally-opposed fastener-receiving apertures, and a flexible snap arm.
Figure 26:
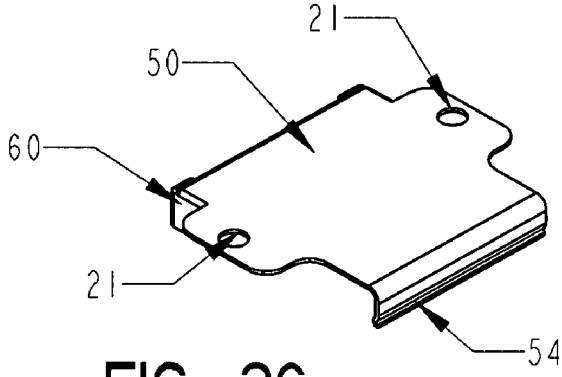
FIG. 26 is an inferior anterior perspective view of the clip bracket of the present invention showing a wall-hanging engaging surface, laterally-opposed fastener-receiving apertures, and a flexible snap arm.
Figure 27:
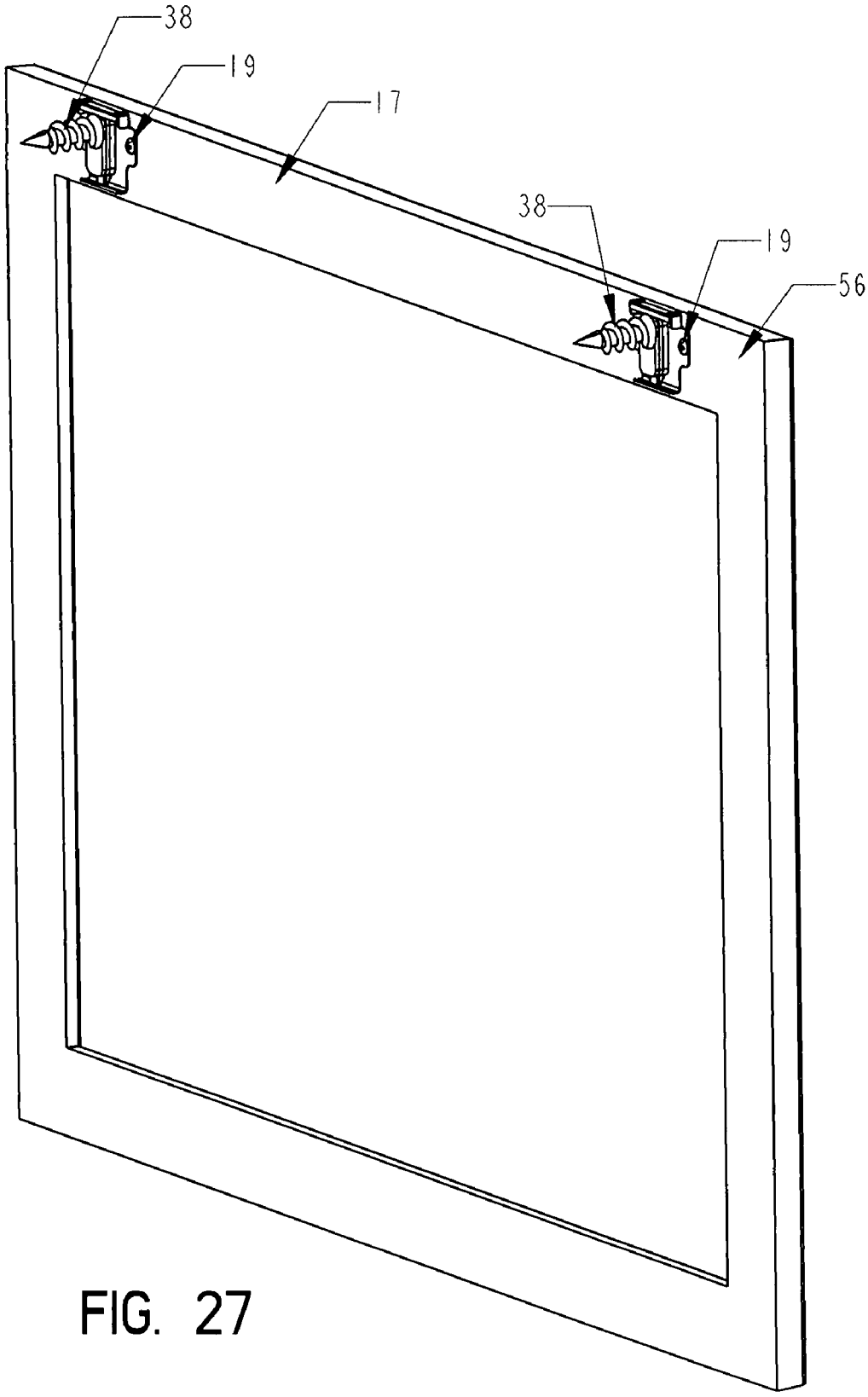
FIG. 27 is a posterior perspective view of laterally opposed hanger assemblies (with screw mounts) snap-fit received in laterally-opposed, screw-mounted clip brackets as mounted to a superior posterior portion of a generic wall-hanging.
Figure 28:
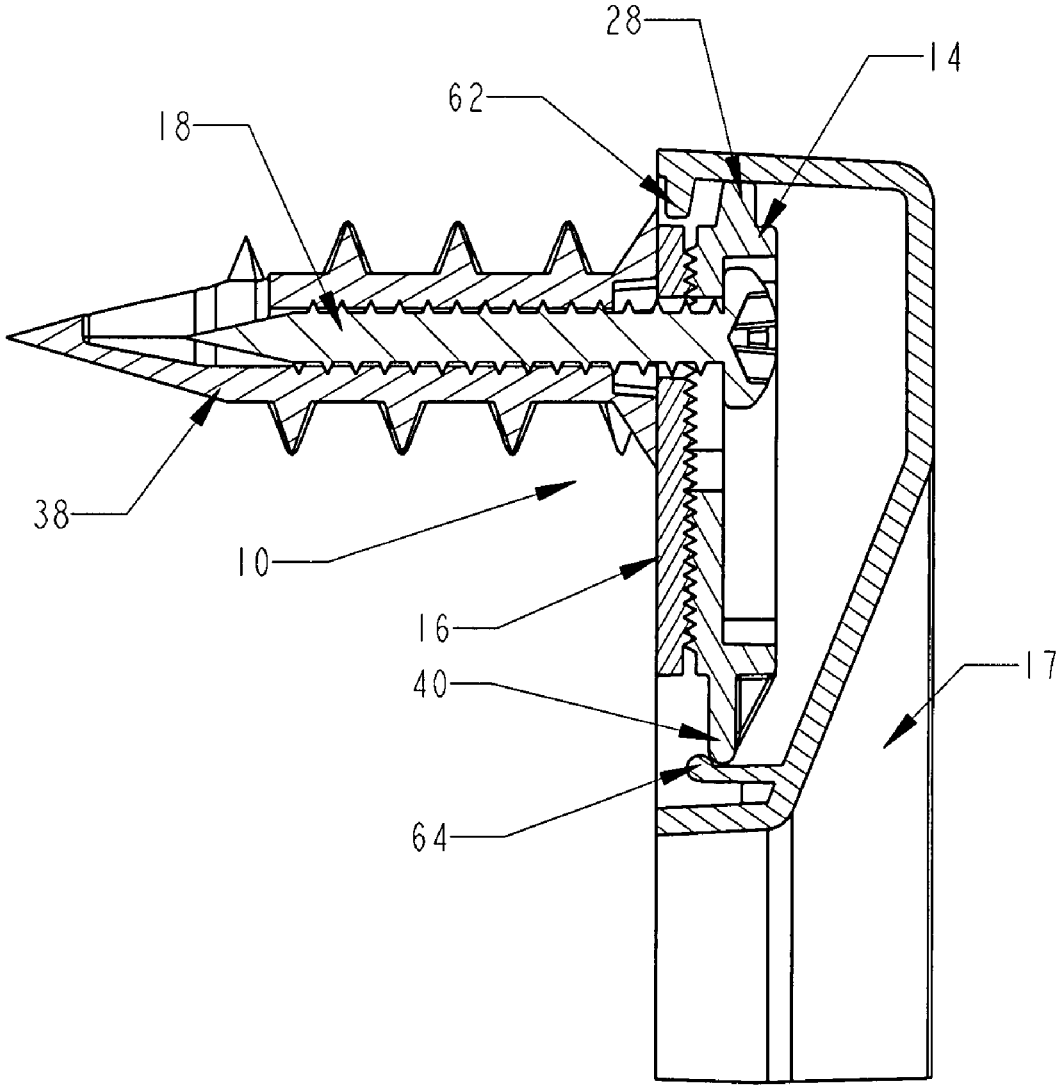
FIG. 28 is an enlarged left lateral side depiction of a screw-mounted hanger assembly shown in the first vertical orientation for mounting to a wall medium and as received in a bracket-like formation integrally formed with a wall-hanging. Note, the hanger tab of the hanger is received in an integrally formed hanger pocket of the wall-hanging and the snap bar of the hanger is engaged by an integral snap arm of the wall-hanging.

As further prefatorily stated, the first main hanger body may preferably comprise a snap bar 40. It may be seen from an inspection of the noted figures that the snap bar 40 is preferably and integrally formed in underlying relation to the center slot 26 for enabling snap-fit engagement of the hanger 14 to certain hanger-receiving structure, as may preferably defined by a clip bracket 50 as generally illustrated and referenced in FIGS. 21-26, and 31-33. Clip bracket 50 is preferably comprised from elastically deformable material, such as spring steel, and comprises a main bracket body, a hanger pocket as at 52 in FIGS. 21-25, and 31-33; and a flexible snap arm as at 54 in FIGS. 21-26. Further, it is contemplated that certain means for fastening the clip bracket 50 to a target wall-hanging 17 such as certain fasteners or screws 19 and fastener-receiving apertures (as at reference numeral 21) may be cooperable with the clip bracket 50 for attaching the clip bracket 50 to a target wall-hanging 17 for forming a bracketed wall-hanging 56 as generally depicted in FIGS. 22 and 27.

It is contemplated that hanger pocket 52 may well function to slidably receive the hanger tab 28 for lateral or horizontal adjustment. In this regard, the reader is directed to FIGS. 31-33. From a comparative inspection of the noted figures, it may be readily seen that the hanger tab 28 (otherwise pocket-received and pocket-concealed in the noted figures) is laterally slidable as received within the hanger pocket 52 for enabling horizontal or lateral adjustment of the hanger 14 relative to the clip bracket 50. Clip bracket further comprises a flexible or elastically displaceable snap arm 54 that may be operable displaced for receiving or engaging the snap bar 40. As the snap arm 54 is restored to its relaxed equilibrium position (generally depicted in FIG. 23), the snap arm 54 functions to forcefully retain the end of the snap bar 40 for selectively retaining the hanger 14 at the desired laterally or horizontally adjusted position relative to the clip bracket 50. The main bracket body comprises a certain bracket width (as at reference numeral 58 in FIG. 24) greater in magnitude than the widths of the hanger 14 and hanger mount 16 for enabling the lateral or horizontal adjustment of the hanger assembly 10 relative to the clip bracket 50. The hanger pocket 52 may further preferably comprise capped ends (as at 60 in FIGS. 2123-26, and 31-33), which capped ends 60 essentially function to prevent the hanger assembly 10 from becoming disengaged from the clip bracket 50 during horizontal adjustment.

While the above description contains much specificity, this specificity should not be construed as limitations on the scope of the invention, but rather as an exemplification of the invention. For example, as is described hereinabove, it is contemplated that the present invention essentially discloses an assembly (as at reference numeral 10) for enabling adjustment of a wall-hanging 17, which assembly comprises a dish-shaped hanger 14, a hanger mount 16, and certain fastening means for fastening the hanger 14 and hanger mount 16 to a wall 12. The dish-shaped hanger 14 and the hanger mount 16 preferably have confronting sets of serrations as at 22 and 32 sized and shaped for locking engagement together in variable adjustable positions so that the dish-shaped hanger 14 and the hanger mount 16 can be moved longitudinally relative to one another and thus for finely and vertically adjusting the dish-shaped hanger 14 and the hanger mount 16 relative to one another.

The dish-shaped hanger 14 has an elongated center slot 26 therein and with the fastening means are engageable through the slot 26 and through a center mount hole (as at 36) provided in said hanger mount 16. The dish-shaped hanger 14 has a hanger tab 28 integrally formed with an upper section of the dish-shaped hanger 14 (preferably integrally formed with the rim 15), wherein the dish-shaped hanger 14 defines a dished area encompassing the elongated center slot 14 and the dish-received or dish-lodged fastening means.

The hanger assembly 10 is usable in combination with a clip bracket 50 mountable to a target wall-hanging 17 for forming a bracketed wall-hanging (as at 56). The clip bracket 50 comprises a main bracket body, a hanger pocket 52, and means for fastening the clip bracket 50 to the target wall-hanging 56 and for forming the aforementioned bracketed wall-hanging 56. The hanger pocket 52 receives the hanger tab 28, and the bracketed wall-hanging is snap-fittable to the assembly 10 (as for example via cooperable engagement of a snap bar 40 (of the hanger 14) and snap arm 54 (of the clip bracket 50)).

Stated another way, the present invention teaches an adjuster assembly for enabling (two-dimensional or vertical-horizontal) adjustment of a wall-hanging, and essentially comprises a hanger, a hanger mount, and fastening means for fastening the hanger and hanger mount to a wall. The hanger and the hanger mount have confronting sets of serrations sized and shaped for locking engagement together in vertically adjustable positions. The hanger comprises a raised annular rim opposite said serrations, an elongated slot (formed through serrations on the hanger). The hanger further comprises certain means for retaining a wall hanging, as may be defined by the hanger tab 28 or similar other structure. The hanger mount comprises a mount aperture (formed through serrations on the hanger mount). The elongated slot and mount aperture function to receive said fastening means, and the annular rim functions to hollow-conceal said fastening means.

The hanger tab is preferably integrally formed with an upper rim section of the raised annular rim and extends upwardly for providing stop structure engageable with a wall hanging wire or cord. The stop structure (i.e. the upwardly extending structure of the tab 28) may well function to retain the wall hanging when engaged therewith. The hanger tab 28 is cooperable with a bracket assembly (such as clip bracket 50), which bracket assembly may comprise a C-shaped bracket body, a hanger pocket, and means for fastening the bracket body to a target wall-hanging (for forming a bracketed wall-hanging). The hanger pocket functions for slidably and laterally receiving the hanger tab for enabling horizontal adjustment. The bracketed wall-hanging is thus horizontally adjustable and preferably snap-fittable to the adjuster assembly.

Figure 29:
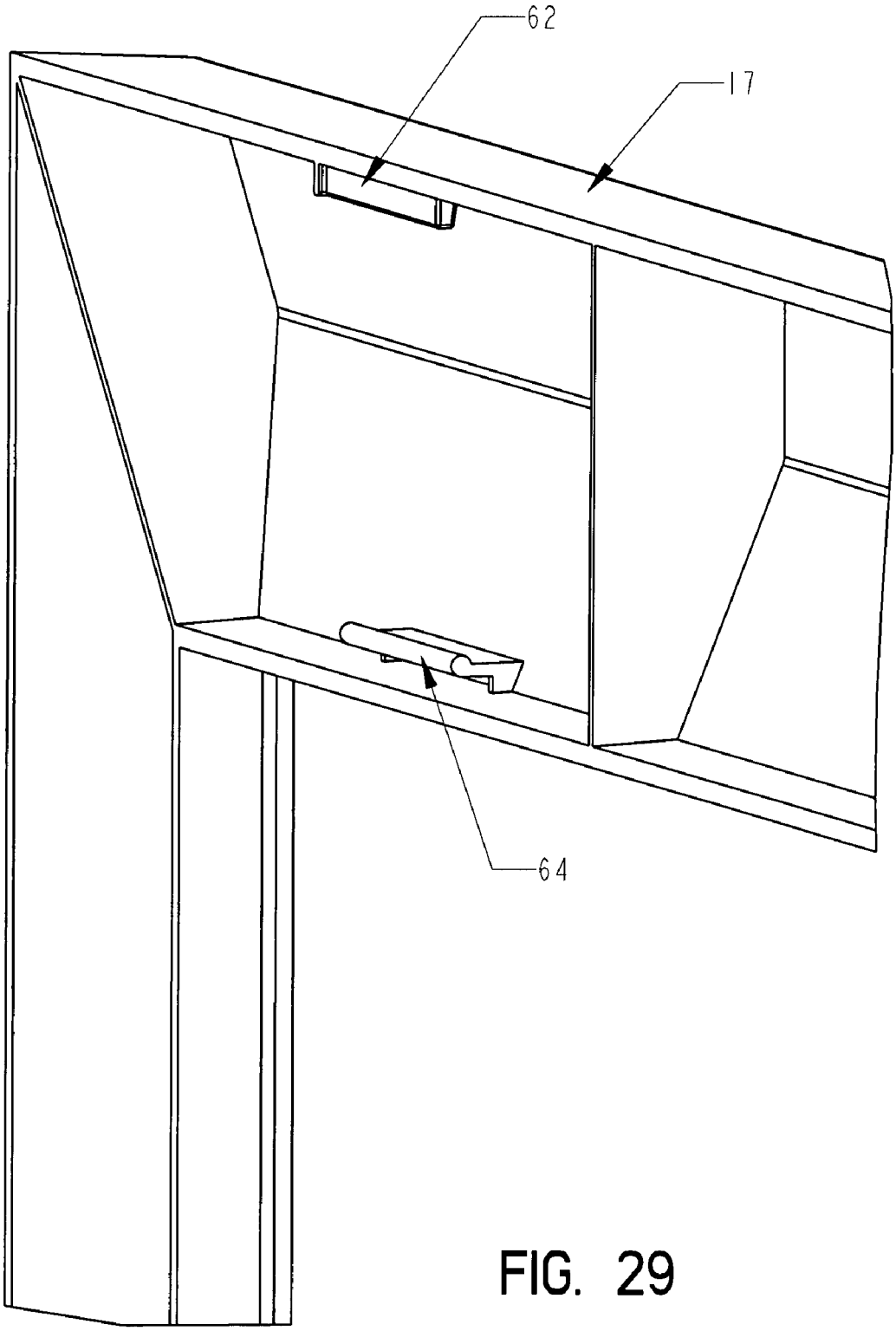
FIG. 29 is an enlarged fragmentary posterior depiction of a wall-hanging article having integrally formed tab stop structure and snap bar-engaging structure, the tab stop structure for effecting a hanger pocket and the snap bar-engaging structure for engaging the snap bar of the hanger of the present invention.
Figure 30:
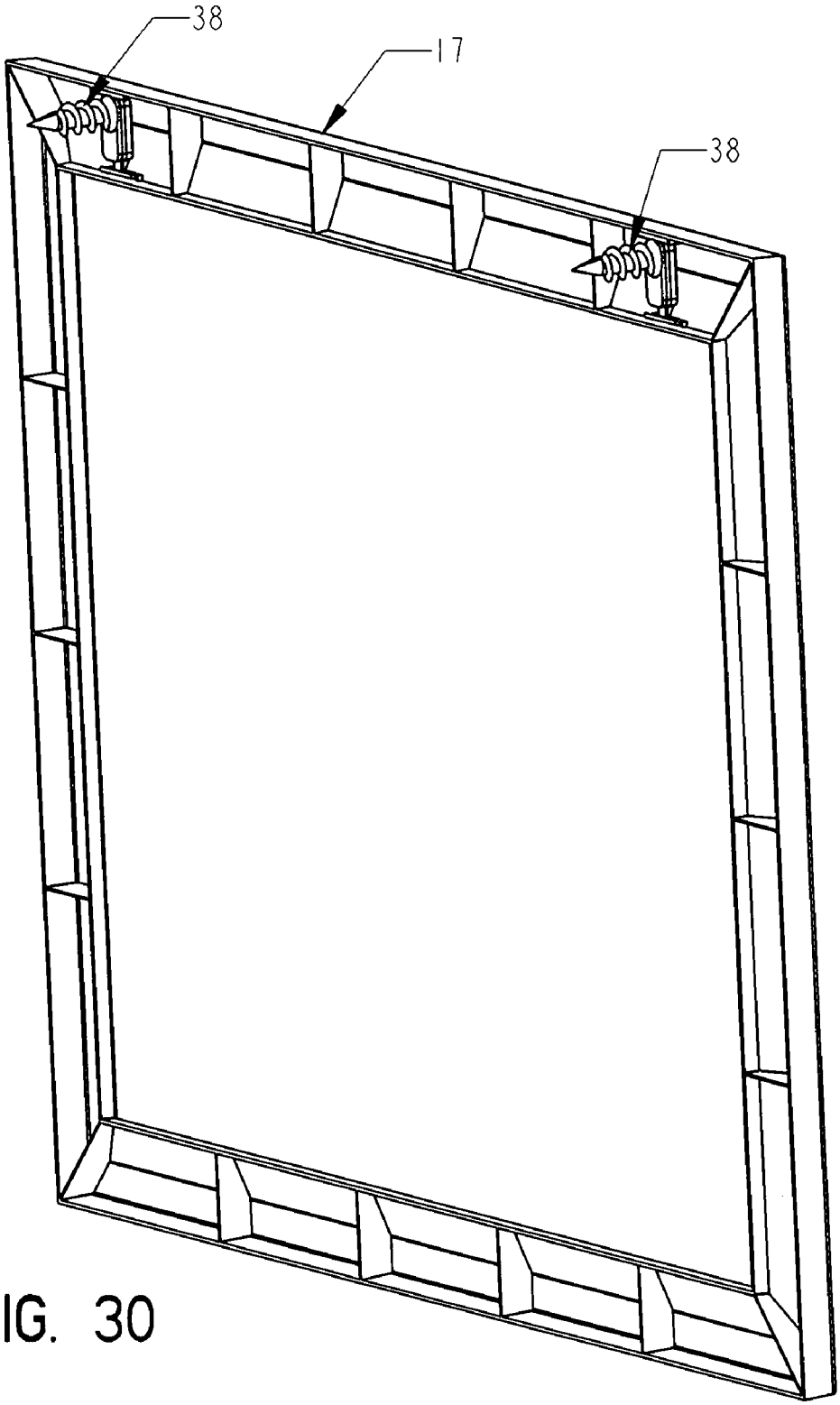
FIG. 30 is a posterior perspective view of laterally opposed hanger assemblies (with screw mounts) snap-fit received in laterally-opposed, integrally formed bracket-like assemblies as integrally formed at a superior posterior portion of a generic wall-hanging.
Figure 31:
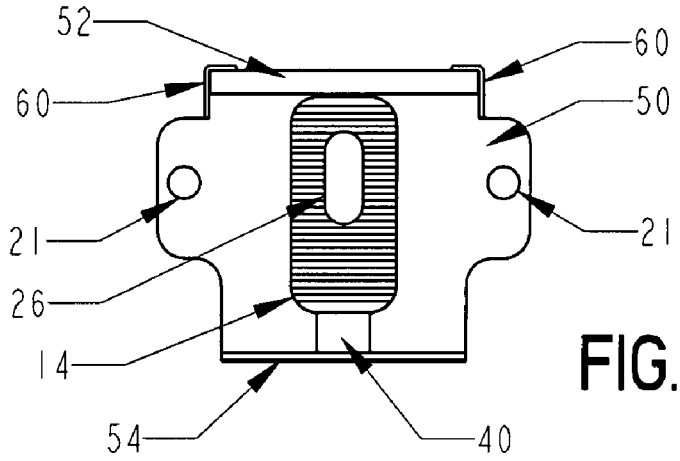
FIG. 31 is a posterior plan type depiction of a hanger (with serrations removed) snap-fit received in a clip bracket of the present invention, depicting the hanger in a centered position relative to the clip bracket.
Figure 32:
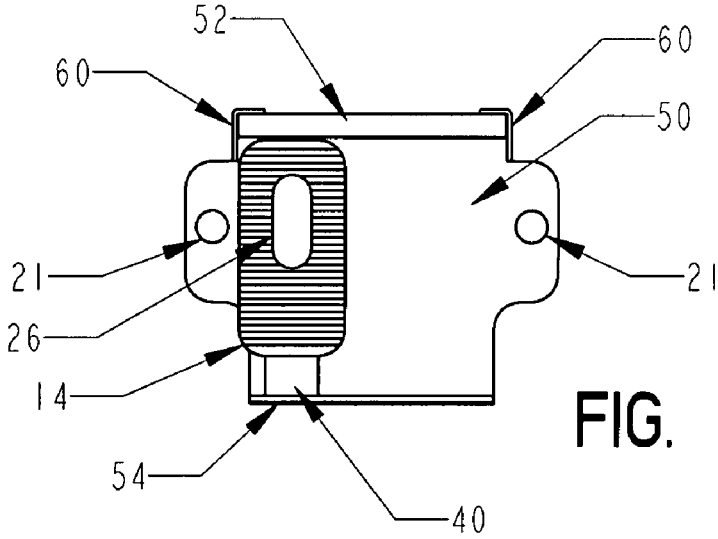
FIG. 32 is a posterior plan type depiction of a hanger (with serrations removed) snap-fit received in a clip bracket of the present invention, depicting the hanger in a laterally left position relative to the clip bracket.
Figure 33:
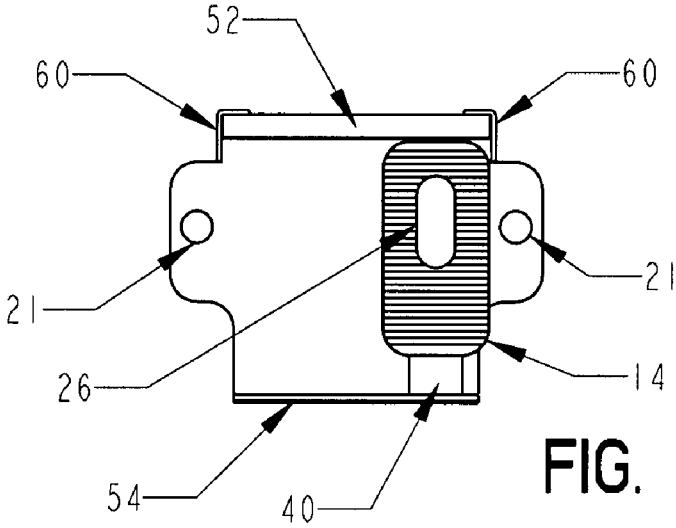
FIG. 33 is a posterior plan type depiction of a hanger (with serrations removed) snap-fit received in a clip bracket of the present invention, depicting the hanger in a laterally right position relative to the clip bracket.

It is contemplated that the essential features of the clip bracket 50 may be integrally formed with a target wall-hanging 56. In this regard, it is contemplated that certain bracket-like structure may be integrally formed with the wall-hanging and defined by an upper tab-receiving, pocket-forming tab structure 62 as generally illustrated and referenced in FIGS. 28 and 29; and a bar-engaging, snap arm 64 as further generally illustrated and referenced in FIGS. 28 and 29. Together, tab structure 62 and snap arm 64 provide structure equivalent to the clip assembly insofar as the cooperative engagement of hanger assembly is concerned.

It is thus further contemplated that the adjustable wall-hanging assembly, may be said to essentially comprise a hanger assembly and a wall-hanging, wherein the hanger assembly comprises a hanger, a hanger mount, and fastening means for fastening the hanger and hanger mount to a wall substantially as heretofore specified; and the wall-hanging essentially comprises posterior, integrally formed structure (s) (such as tab 62 and arm 64) for engaging the hanger assembly. The fastening means may effectively function to mount the hanger assembly to a wall, and said integrally formed structure may well function to mount the wall-hanging to the hanger assembly.

Accordingly, although the invention has been described by reference to certain preferred and alternative embodiments, and combinations thereof, it is not intended that the novel assemblies be limited thereby, but that modifications thereof are intended to be included as falling within the broad scope and spirit of the foregoing disclosure, the following claims and the appended drawings.

I claim:

1. A wall-hanging system, the wall-hanging system for hanging a wall-hanging and for enabling two-dimensional adjustment of the wall-hanging, the wall-hanging system comprising, in combination:

a hanger assembly, the hanger assembly comprising a hanger, a hanger mount, and means for fastening the hanger assembly to a wall, the hanger comprising a first main hanger body, the first main hanger body comprising a back side, a center slot, a hanger tab, and a snap bar, the back side comprising a first set of serrations positioned in side-to-side spaced relation to one another, the hanger mount comprising a second main mount body, the second main mount body comprising a front side and a center mount hole, the front side comprising a second set of serrations positioned in side-to-side spaced relation to one another and being sized, shaped, and positioned in confronting relation to said first set of serrations, the center mount hole confronting the center slot, the hanger tab being positioned for supporting an object hung on the hanger tab, the hanger tab being fixedly connected to said first main hanger body overlying said center slot with a free end of said hanger tab extending upwardly, the snap bar being formed in underlying relation to the center slot for snap-fitting the hanger to hanger-receiving structure, the first main hanger body being vertically adjustable relative to said second main mount body to assist in adjusting the first and second sets of serrations when being disengaged and re-engaged in different positions with relation to one another, the hanger and hanger mount being assembled together by meshing said first and second sets of serrations in a pre-selected position to accommodate users' positioning requirements while maintaining the center slot and the center mount hole in coplanar alignment, and a clip bracket, the clip bracket comprising a main bracket body, a hanger packet, a flexible snap arm, a bracket width, and means for fastening the clip bracket to a target wall-hanging and for forming a bracketed wall-hanging, the hanger pocket for receiving the hanger tab, the flexible snap arm for cooperably engaging the snap bar and for snap-fitting the hanger to the clip bracket, the bracketed wall-hanging thus being snap-fittable to the hanger assembly, the bracket width being dimensioned for enabling horizontal adjustment of the hanger assembly relative to the main bracket body.

2. The wall-hanging system of claim 1 wherein the first and second sets of serrations are finely adjustable down to 1/32 of an inch.

3. The wall-hanging system of claim 1 wherein the first main hanger body is dish-shaped and has an annular rim hanger section surrounding said center slot in a bottom section of the first main hanger body, the annular rim hanger section for hollow-concealing the means for fastening the hanger assembly to the wall.

4. The wall-hanging system of claim 1 wherein the first and second sets of serrations are of identical size and shape and are arranged in rows leaving channels between the serrations which are open at opposite ends and with the channels being of similar shape to said serrations for receipt of a serration in an opposing set of serrations in nested engagement therewith, certain of the second set of serrations being visible from a front side of the wall-hanging assembly when viewed through said center slot.

5. The wall-hanging assembly of claim 1 wherein the hanger pocket comprises capped ends, the capped ends for preventing the hanger assembly from becoming disengaged from the clip bracket during horizontal adjustment.

6. A wall-hanging assembly, the wall-hanging assembly for hanging a wall-hanging and for enabling adjustment of the wall-hanging, the wall-hanging assembly comprising:

a hanger assembly, the hanger assembly comprising a hanger and a hanger mount, the hanger comprising a first main hanger body, the first main hanger body comprising a back side, a center slot, and a hanger tab, the back side comprising a first set of serrations positioned in side-to-side spaced relation to one another, the hanger mount comprising a second main mount body, the second main mount body comprising a front side and a center mount hole, the front side comprising a second set of serrations positioned in side-to-side spaced relation to one another and being sized, shaped, and positioned in confronting relation to said first set of serrations, the center mount hole confronting the center slot, the hanger tab being positioned for supporting an object hung on the hanger tab, the hanger tab being fixedly connected to said first main hanger body overlying said center slot with a free end of said hanger tab extending upwardly, the first main hanger body being vertically adjustable relative to said second main mount body to assist in adjusting the first and second sets of serrations when being disengaged and re-engaged in different positions with relation to one another, the hanger and hanger mount being assembled together by meshing said first and second sets of serrations in a pre-selected position to accommodate users' positioning requirements while maintaining the center slot and the center mount hole in coplanar alignment, and a mounting fastener, the mounting fastener extending through said center slot and said center mount hole retaining the hanger and the hanger mount together in superimposed lapped retained assembly in the pre-selected position, the mounting fastener underlying the hanger tab for easy access when being extended through said center slot and said center mount hole.

7. The wall-hanging assembly of claim 6 wherein the first and second sets of serrations are finely adjustable down to 1/32 of an inch.

8. The wall-hanging assembly of claim 6 wherein the first main hanger body is dish-shaped and has an annular rim hanger section surrounding said center slot in a bottom section of the first main hanger body, the mounting fastener having a fastener head housed inside said annular rim hanger section when the mounting fastener head rests on an upper hanger section with the mounting fastener then being extended through center slot and said center mount hole.

9. The wall-hanging assembly of claim 6 wherein the first and second sets of serrations are of identical size and shape and are arranged in rows leaving channels between the serrations which are open at opposite ends and with the channels being of similar shape to said serrations for receipt of a serration in an opposing set of serrations in nested engagement therewith, certain of the second set of serrations being visible from a front side of the wall-hanging assembly when viewed through said center slot.

10. The wall-hanging assembly of claim 6 wherein the first main hanger body comprises a snap bar, the snap bar being formed in underlying relation to the center slot for snap-fitting the hanger to hanger-receiving structure.

11. The wall-hanging assembly of claim 10 comprising, in combination, a clip bracket, the clip bracket comprising a main bracket body, a hanger pocket, a flexible snap arm, and means for fastening the clip bracket to a target wall-hanging said means for forming a bracketed wall-hanging, the hanger pocket for receiving the hanger tab, the flexible snap arm for cooperably engaging the snap bar and for snap-fitting the hanger to the clip bracket, the bracketed wall-hanging thus being snap-fittable to the hanger assembly.

12. The wall-hanging assembly of claim 11 wherein the main bracket body comprises a bracket width, the bracket width for enabling horizontal adjustment of the hanger assembly relative to the main bracket body.

13. The wall-hanging assembly of claim 12 wherein the hanger pocket comprises capped ends, the capped ends for preventing the hanger assembly from becoming disengaged from the clip bracket during horizontal adjustment.

14. A wall-hanging assembly, the wall-hanging assembly for hanging a wall-hanging and for enabling adjustment of the wall-hanging, the wall-hanging assembly comprising:

a hanger assembly, the hanger assembly comprising a hanger and a hanger mount, the hanger comprising a first main hanger body, the first main hanger body is dish-shaped and comprises a back side, a center slot, an annular rim hanger section, and a hanger tab, the back side comprising a first set of serrations positioned in side-to-side spaced relation to one another, the annular rim surrounding the center slot in an upper section of the first main hanger body and comprising an upper rim section and a lower rim section, the hanger tab being integrally formed with the upper rim section, the hanger mount comprising a second main mount body, the second main mount body comprising a front side and a center mount hole, the front side comprising a second set of serrations positioned in side-to-side spaced relation to one another and being sized, shaped, and positioned in confronting relation to said first set of serrations, the center mount hole confronting the center slot, the hanger tab being positioned for supporting an object hung on the hanger tab, the hanger tab being fixedly connected to said first main hanger body overlying said center slot with a free end of said hanger tab extending upwardly, the first main hanger body being vertically adjustable relative to said second main mount body to assist in adjusting the first and second sets of serrations when being disengaged and re-engaged in different positions with relation to one another, the hanger and hanger mount being assembled together by meshing said first and second sets of serrations in a pre-selected position to accommodate users' positioning requirements while maintaining the center slot and the center mount hole in coplanar alignment, and a mounting fastener, the mounting fastener comprising a fastener head, the mounting fastener extending through said center slot and said center mount hole retaining the hanger and the hanger mount together in superimposed lapped retained assembly in the pre-selected position, the mounting fastener underlying the hanger tab for easy access when being extended through said center slot and said center mount hole, the fastener head being housed inside said annular rim hanger section when the fastener head rests on an upper hanger section with the mounting fastener then being extended through center slot and said center mount hole.

15. The wall-hanging assembly of claim 14 wherein the first and second sets of serrations are finely adjustable down to 1/32 of an inch.

16. The wall-hanging assembly of claim 14 wherein the first and second sets of serrations are of identical size and shape, and are ranged in rows leaving channels between the serrations which are open at opposite ends and with the channels being of similar shape to said serrations for receipt of a serration in an opposing set of serrations in nested engagement therewith, certain of the second set of serrations being visible from a front side of the wall-hanging assembly when viewed through said center slot.

17. The wall-hanging assembly of claim 14 wherein the first main hanger body comprises a snap bar, the snap bar being formed in underlying relation to the center slot for snap-fitting the hanger to hanger-receiving structure.

18. The wall-hanging assembly of claim 17 comprising, in combination, a clip bracket, the clip bracket comprising a main bracket body, a hanger pocket, a flexible snap arm, and means for fastening the clip bracket to a target wall-hanging, said means for forming a bracketed wall-hanging, the hanger pocket for receiving the hanger tab, the flexible snap arm for cooperably engaging the snap bar and for snap-fitting the hanger to the clip bracket, the bracketed wall-hanging thus being snap-fittable to the hanger assembly.

19. The wall-hanging assembly of claim 18 wherein the main bracket body comprises a bracket width, the bracket width for enabling horizontal adjustment of the hanger assembly relative to the main bracket body.

20. The wall-hanging assembly of claim 19 wherein the hanger pocket comprises capped ends, the capped ends for preventing the hanger assembly from becoming disengaged from the clip bracket during horizontal adjustment.

21. An adjuster assembly for enabling adjustment of a wall-hanging, said adjuster assembly comprising a dish-shaped hanger, a hanger mount, and fastening means for fastening the hanger and hanger mount to a wall, the dish-shaped hanger and the hanger mount having confronting sets of serrations sized and shaped for locking engagement together in variable adjustable positions so that the dish-shaped hanger and the hanger mount can be moved longitudinally relative to one another for fine vertical adjustment of the dish-shaped hanger and the hanger mount relative to one another, the dish-shaped hanger having an elongated center slot therein and with the fastening means being engageable through the slot and through a center mount hole provided in said hanger mount, the dish-shaped hanger having a hanger tab integrally formed with an upper section of the dish-shaped hanger, wherein the dish-shaped hanger defines a dished area encompassing the elongated center slot and the fastening means, the fastening means being lodged in the dished area.

22. The adjuster assembly of claim 21 comprising, in combination, a clip bracket, the clip bracket comprising a main bracket body, a hanger pocket, and means for fastening the clip bracket to a target wall-hanging, said means for forming a bracketed wall-hanging, the hanger pocket for receiving the hanger tab, the bracketed wall hanging being snap-fittable to said adjuster assembly.

23. The adjuster assembly of claim 22 wherein the main bracket body comprises a bracket width, the bracket width for enabling horizontal adjustment of the adjuster assembly relative to the main bracket body.

24. The wall-hanging assembly of claim 23 wherein the hanger pocket comprises capped ends, the capped ends for preventing the adjuster assembly from becoming disengaged from the clip bracket during horizontal adjustment.

25. An adjuster assembly for enabling adjustment of a wall-hanging, the adjuster assembly comprising a hanger, a hanger mount and fastening means for fastening the hanger and hanger mount to a wall, the hanger and the hanger mount having confronting sets of serrations sized and shaped for locking engagement together in vertically adjustable positions, the hanger comprising a raised annular rim opposite said serrations, an elongated slot, and a hanger tab, the hanger mount comprising a mount aperture, the elongated slot and mount aperture for receiving said fastening means, the annular rim for hollow-concealing said fastening means, the hanger tab being integrally formed with an upper rim section of the raised annular rim and extending upwardly for providing ston structure engageable with a wall hanging, the stop structure for retaining the wall hanging when engaged therewith.

26. The assembly of claim 25 wherein the hanger tab is cooperable with a bracket assembly, the bracket assembly comprising a bracket body, a hanger pocket, and means for fastening the bracket body to a target wall-hanging and thus for forming a bracketed wall-hanging, the hanger pocket for slidably and laterally receiving the hanger tab for enabling horizontal adjustment, the bracketed wall-hanging thus being horizontally adjustable and snap-fittable to the adjuster assembly.

27. The adjuster assembly of claim 25 comprising, in combination, a bracket assembly, the bracket assembly comprising a bracket body and means for fastening the bracket assembly to a target wall-hanging and forming a bracketed wall-hanging, the bracketed wall-hanging being snap-fittable to the adjuster assembly.

28. The adjuster assembly of claim 27 wherein the bracket body comprises a bracket width, the bracket width for enabling horizontal adjustment of the adjuster assembly relative to the bracket body.

29. An adjustable wall-hanging assembly, the wall-hanging assembly comprising, in combination:

a hanger assembly and a wall-hanging, the hanger assembly comprising a hanger, a hanger mount, and fastening means for fastening the hanger and hanger mount to a wall, the hanger and the hanger mount having confronting sets of serrations sized and shaped for locking engagement together in vertically adjustable positions, the hanger comprising a raised annular rim opposite said serrations, an elongated slot, and a hanger tab, the hanger mount comprising a mount aperture, the elongated slot and mount aperture for receiving said fastening means, the annular rim for hollow-concealing said fastening means, the wall-hanging comprising posterior, integrally formed structure for engaging the hanger assembly, the fastening means for mounting the hanger assembly to a wall, the integrally formed structure for mounting the wall-hanging to the hanger assembly, the hanger tab being integrally formed with an upper rim section of the raised annular rim and extending upwardly for providing stop structure engageable with a wall hanging, the stop structure for retaining the wall hanging when engaged therewith.

* * * * *